United States Patent [19]

Kiuchi et al.

[11] Patent Number: 4,676,211

[45] Date of Patent: Jun. 30, 1987

[54] APPARATUS FOR CONTROL OF NUMBER OF IDLING ROTATIONS OF INTERNAL COMBUSTION ENGINE

[75] Inventors: Takeo Kiuchi; Takahiro Iwata, both of Tokyo, Japan

[73] Assignee: Honda Giken Kogyo Kabushiki Kaisha, Tokyo, Japan

[21] Appl. No.: 871,971

[22] Filed: Jun. 9, 1986

[30] Foreign Application Priority Data

Jun. 24, 1985 [JP] Japan ..... 60-137445

[51] Int. Cl.[4] ..... F02D 41/08

[52] U.S. Cl. ..... 123/339; 123/585

[58] Field of Search ..... 123/339, 493, 585

[56] References Cited

U.S. PATENT DOCUMENTS 4,484,553 11/1984 Kobayashi et al. ..... 123/339
4,506,641 3/1985 Hasegawa ..... 123/339
4,508,075 4/1985 Takao et al. ..... 123/339
4,509,477 4/1985 Takao et al. ..... 123/339
4,616,614 10/1986 Abe ..... 123/339

*Primary Examiner*—Willis R. Wolfe, Jr.
*Attorney, Agent, or Firm*—Pollock, Vande Sande and Priddy

[57] ABSTRACT

When the engine RPM falls below a lower limit of a target RPM of idling while an engine is in an idle operation, a control valve is shifted to the open-loop control mode instead of the conventional feedback control mode so as to enable the engine RPM range to be quickly increased up to within the target RPM of idling rotations. Said control valve is disposed in a bypass which communicates with the upstream side and the downstream side of the throttle valve in intake passage to adjust the volume of an inspired air. The solenoid current command (amount of control) for adjusting the opening degree of the control valve during the period of the open-loop control mode is set at a level higher than that immediately before the feedback control mode shifts to the open-loop control mode.

5 Claims, 5 Drawing Figures

APPARATUS FOR CONTROL OF NUMBER OF IDLING ROTATIONS OF INTERNAL COMBUSTION ENGINE

BACKGROUND OF THE INVENTION

1. Field of the Invention:

This invention relates to an apparatus for the control of the number of idling rotations of an internal combustion engine (hereinafter referred to simply as "engine"), and more particularly to an apparatus for the control of the number of idling rotations of the engine, adapted so that when the number of rotations of the engine under closed-loop control falls below the lower limit of the prescribed range of idling rotations, the engine is shifted to the open-loop control mode and the number of engine rotation is quickly increased to within the prescribed range of idling rotation numbers.

2. Description of the Prior Art:

Heretofore, it has been customary during the so-called idling operation of an engine, i.e. when the operation of the engine is continuing while the throttle valve disposed in the intake manifold of the engine is in a substantially closed state, to control the number of idling rotations of the engine by controlling the amount of air taken into the engine with a control valve disposed in a bypass which communicates with the upstream and downstream sides of the throttle valve.

In other words, during the idling operation, the degree of opening of the control valve is controlled in the closedloop mode so as to ensure supply of the inspired air to the engine in the prescribed amount and approximate the number of idling rotations of the engine to the prescribed level.

To be specific, the exciting current fed to a solenoid which proportionately controls the opening area of the control valve is adapted to be fixed in accordance with the solenoid current command Icmd to be obtained by the following formula (1).

$$Icmd = Ifb(n) \quad (1)$$

In this formula, Ifb(n) represents the term of PID feedback control for effecting proportional (P term), integral (I term), and differential (D term) control based on the difference between the target number of idling rotations and the existing number of engine rotations.

It is well known that in the engine of the electronically controlled fuel injection type, an increase in the amount of the inspired air results in an increase in the amount of the fuel injected and consequently in the amount of the mixture to be formed.

The conventional technique described above has entailed the following problem.

During the idling operation, the coefficients (control gains) of the P term, I term, and D term are fixed at relatively small levels, while the degree of opening of the control valve is subjected to the feedback control based on the PID feedback control term. This is because the stability of the number of idling rotations during the steady idle operation is rather impaired when the control gains are too large.

During the idle operation of the engine, when the output side of the engine is connected to driving wheels (for the engine to assume an in-gear state) while the throttle valve is kept in a substantially completely closed state, a load is applied on the engine and the number of idling rotations decreases abruptly. In response to this decrease, the value of the feedback control term Ifb(n) and consequently the quantity of the solenoid current command Icmd are increased and the control valve is driven in the direction of opening. Since the control gains of the feedback control term are relatively small as described above, the speeds of response are slow. As the result, the conventional apparatus has had the disadvantage that the engine is liable to stall.

This invention has been produced for the solution of the problem mentioned above.

SUMMARY OF THE INVENTION

For the solution of this problem, this invention is characterized by the fact that, when the number of engine rotations falls below the lower limit of a prescribed range of numbers of idling rotations while the engine is in an idle operation, the control valve is shifted to the open-loop control mode instead of the conventional feedback control mode so as to enable the number of engine rotations to be quickly increased up to within the prescribed range of numbers of idling rotations. In this invention, the solenoid current command (amount of control) for adjusting the opening degree of the control valve during the period of the openloop control mode is set at a level higher than that immediately before the feeback control mode shifts to the open-loop control mode.

The characteristic features of the present invention will become more apparent from the description given in further detail hereinbelow with reference to the accompaning drawings.

DETAILED DESCRIPTION OF THE PREFERRED EMBODIMENTS

Figure 2:
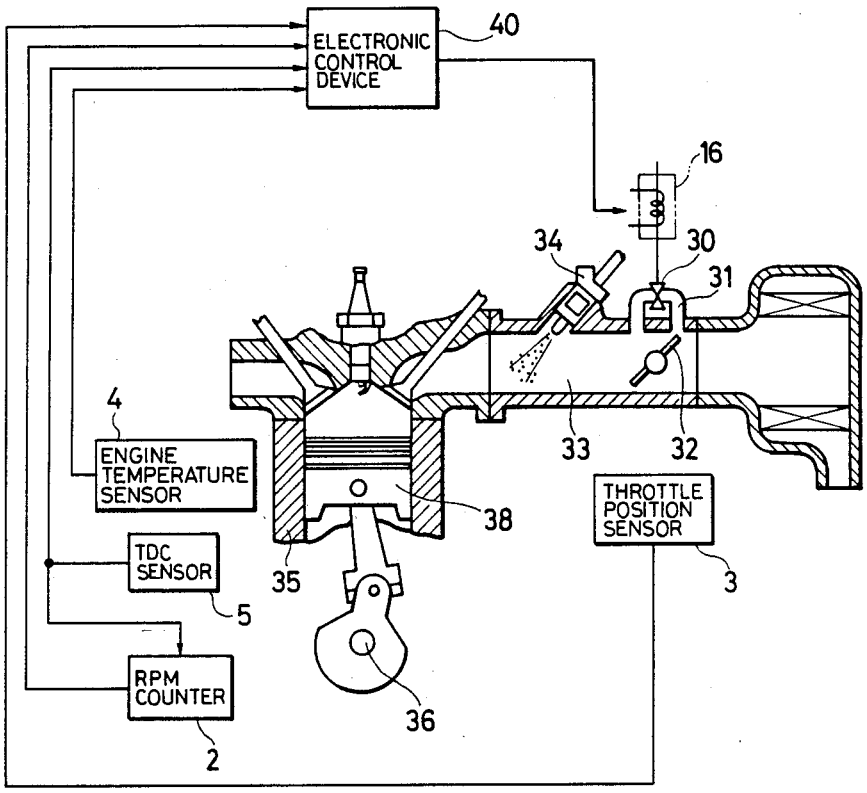
FIG. 2 is a schematic structural diagram illustrating a typical apparatus for the control of the number of idling rotations of an engine as one embodiment of this invention.

Now, the present invention will be described in detail below with reference to the accompanying drawings. FIG. 2 is a schematic structural diagram illustrating a typical apparatus for the control of the number of idling rotations (RPM) of an engine as one embodiment of this invention.

With reference to this diagram, the amount of inspired air in an intake manifold 33 during an idle operation wherein a throttle valve 32 remains in a substantially completely closed state is controlled by a control valve 30 disposed in a bypass 31 which communicates with the upstream and downstream sides of the throttle valve 32. This control valve 30 has the degree of opening or the position thereof fixed in proportion to the magnitude of electric current flowing in a solenoid 16.

The amount of fuel injected from an injection nozzle 34 is fixed by known means in accordance with the amount of inspired air in the intake manifold 33. A piston 38 inside a cylinder 35 produces a reciprocating motion to impart a rotational force to a crank shaft 36.

A TDC sensor 5 issues a pulse when the piston of each of the cylinders reaches 90 degrees prior to the top dead center. In other words, the TDC sensor 5 issues the same number of pulses as the number of cylinders (hereinafter referred to as "TDC pulses") each time the crank shaft 36 completes two rotations and feeds the TDC pulses to an electronic control device 40.

A RPM counter 2 determines the number engine rotations (hereinafter referred to as "RPM") by taking count of intervals of the TDC pulses issued from the TDC sensor 5 and feeds a corresponding digital RPM signal to the electronic control device 40.

A throttle position sensor 3 feeds a position signal regarding the position of throttle valve 32 in the form of a digital signal to the electronic control device 40. An engine temperature sensor 4 detects the temperature TW of engine cooling water and feeds a corresponding digital engine temperature signal to the electronic control device 40.

Figure 3:
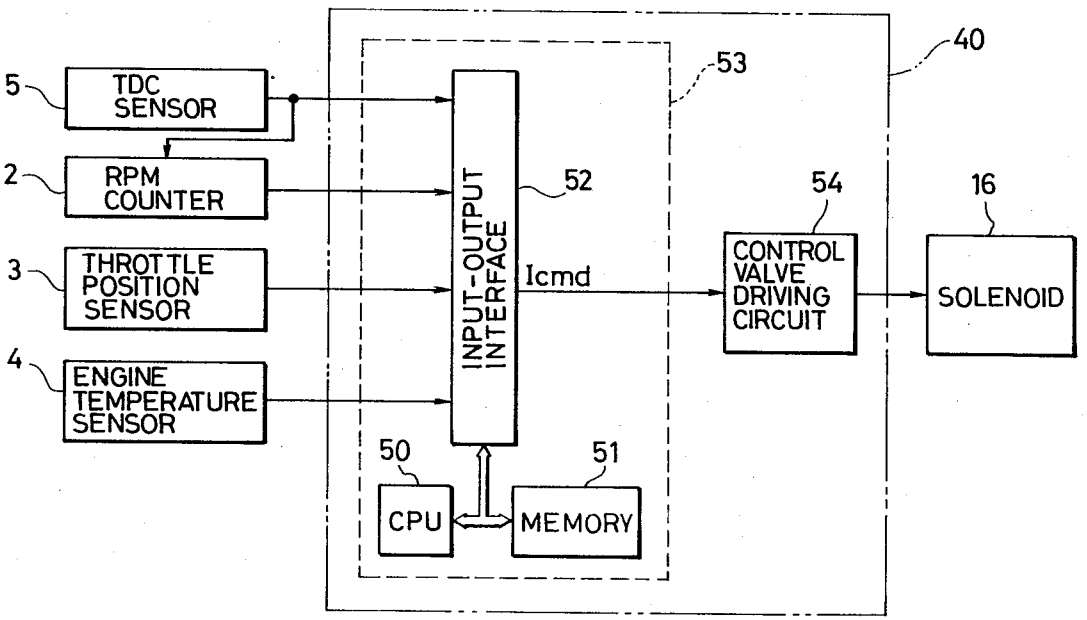
FIG. 3 is a block diagram illustrating a typical schematic structure of the electronic control device of FIG. 2.

FIG. 3 is a block diagram illustrating a typical schematic structure of the electronic control device 40 of FIG. 2.

The electronic control device 40 is composed of a microcomputer 53 consisting of a CPU 50, a memory 51, and an input-output interface 52 and a control valve driving circuit 54 for controlling the electric current flowing in the solenoid 16 in accordance with the command (solenoid current command Icmd) output from the microcomputer 53.

The control valve driving circuit 54 feeds out a control signal for controlling the electric current flowing in the solenoid 16 in accordance with the command Icmd. As the result, the degree of opening of the control valve (FIG. 2) is controlled in accordance with the command Icmd and consequently the number of idling rotations is controlled in accordance with the same command.

Figure 4:
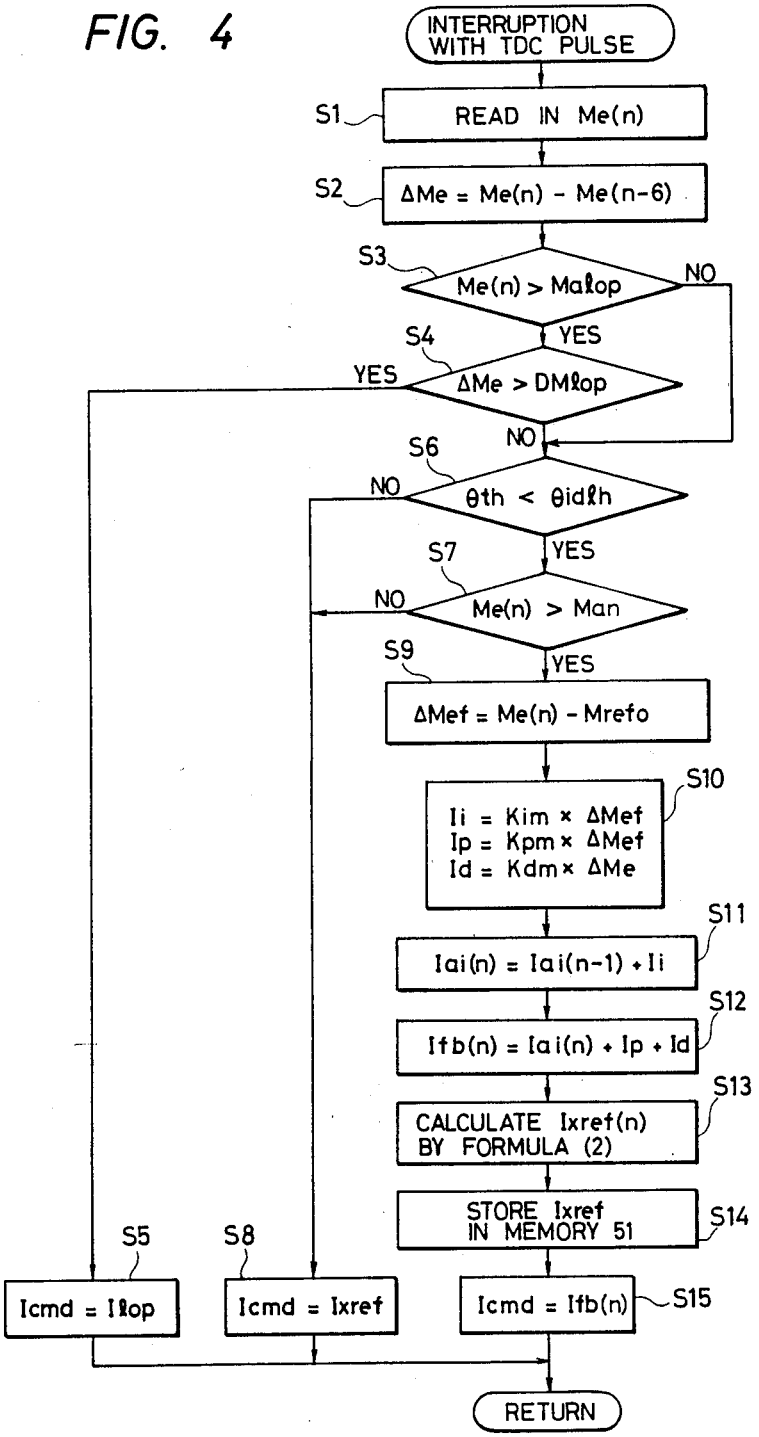
FIG. 4 is a flow chart illustrating the operation of the embodiment of this invention.

Now, the operation of the embodiment of this invention will be described with reference to the accompanying drawings. FIG. 4 is a flow chart for illustrating the operation of the embodiment of this invention. The operation of the flow chart of FIG. 4 is started by an interruption with a TDC pulse.

In Step S1, the reciprocal of the number of engine rotations or a period detected by the RPM counter 2 or a value Me(n) (current value) equivalent thereto is read in.

In Step S2, the difference between the value Me(n) mentioned above and the previous Me measured on the same cylinder as the Me(n) in the previous round which is Me(n-6) when the engine in question happens to be of a 6-cylinder type, namely the rate of change ΔMe of the period is calculated.

In Step S3, judgement is exercised to find whether or not the value Me(n) is larger than the reciprocal of the lower limit of the prescribed range of numbers of idling rotations or quantity, Malop, corresponding thereto.

In other words, judgement is performed as to whether or not the current number of engine rotations is smaller than the lower limit of the range of numbers of idling rotations.

The value, Malop, mentioned above is stored in advance in a memory 51 (FIG. 3).

When the answer is in the negative, the processing skips Step S4 and proceeds to Step S6. If the answer is in the affirmative, the processing proceeds to Step S4.

In Step S4, judgement is exercised to find whether or not the rate of change ΔMe is larger than the standard rate of change, DM lop, of period fixed in advance. When the answer is in the negative, the processing proceeds to Step S6.

When the answer is in the affirmative, the processing proceeds to Step S5 for shifting the engine and consequently the control valve 30 (FIG. 2) into an open loop control mode in a lower speed range.

The standard rate of change, DM lop, is a fixed valve stored in advance in the memory 51.

In Step S5, the value, Ilop, is fed out as a solenoid current command valve, Icmd, to the control valve driving circuit 54.

This Ilop is a current command (quantity of control) which has been read out of the Ne-Ilop table stored in the memory 51, using as a parameter the number of engine rotations, Ne, corresponding to the value Me(n) read in, in Step S1.

Subsequently, the processing returns to the main program.

Figure 5:
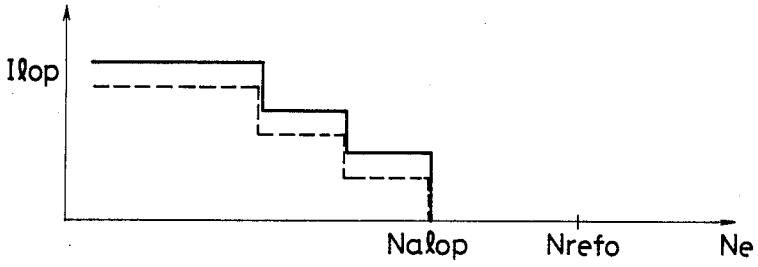
FIG. 5 is a graph showing a typical relation between the number of engine rotations Ne and the quantity of control Ilop.

FIG. 5 is a graph showing the relation between the values, Ne and Ilop. As noted from FIG. 5, the value, Ilop, is set so as to increase stepwise each time the number of engine rotations falls by a prescribed value in the region below the lower limit, Nalop, of the range of numbers of idling rotations. In this invention, the value of Ilop is larger than the quantity of control, Ifb(n), immediately before the processing proceeds to Step S5 and the low speed range open loop control mode is assumed. In FIG. 5, Nrefo denotes the target number of idling rotations.

In Step S6, judgement is exercised to find whether or not the current throttle position, θth, obtained by the throttle position sensor 3 is smaller than the upper limit, θidlh, of the position of the throttle valve 32 during the idle operation.

When the answer is in the negative, the processing proceeds to Step S8. When the answer is in the affirmative, the processing proceeds to Step S7.

In Step S7, judgement is exercised to find whether or not the value, Me(n), received in Step S1 is larger than the reciprocal of the upper limit of the prescribed range of number of idling rotations or the quantity, Man, corresponding thereto. The quantity, Man, is stored in advance in the memory 51. When the answer is in the negative, the processing proceeds to Step S8. When the answer is in the affirmative, the processing proceeds to Step S9.

In Step S8, the learned value, Ixref, which is calculated in Step S13, and then stored in the memory 51 in Step S14, as described afterward, is output as the solenoid current command, Icmd, to the control driving circuit 54 (FIG. 3).

In Step S9, the difference, ΔMef, between the value, Me(n), received in Step S1 and the reciprocal of the target numberr of idling rotation, Nrefo, or the value, Mrefo, corresponding thereto is calculated.

In Step S10, the integration term Ii, the proportional term Ip, and the differential term Id are calculated in accordance with the formulas of calculation shown in FIG. 4, using the value, ΔMe, obtained in Step S2 and the value, ΔMef, obtained in Step S9 and the integration control gain, Kim, the Proportional control gain, Kpm, and the differential control gain, Kdm. The control gains are read out of the memory 51 in which they are stored in advance.

In Step S11, the integration term Ii obtained in Step S10 is added to Iai(n-1) (the value in the previous round) to fix the Iai(n).

In Step S12, the values Ip and Id calculated in Step S10 are added to the value, Iai(n), calculated in Step S11 and the sum is defined as Ifb(n).

In Step S13, the learned value, Ixref(n), defined by the following formula (2) is calculated.

$$Ixref(n)=Iai(n)\times Ccrr/m + Ixref(n-1)\times(m-Ccrr)/m \quad (2)$$

In the formula (2), m and Ccrr are positive numbers which can be arbitrarily set and m and Ccrr have this relation, m>Ccrr.

In Step S14, the learned value, Ixref, calculated as described above is stored in the memory 51.

In Step S15, the value, Ifb(n), calculated in Step S12 is fed out as a solenoid current command, Icmd, to the control valve driving circuit 54. Thereafter, the processing is returned to the main program.

Figure 1:
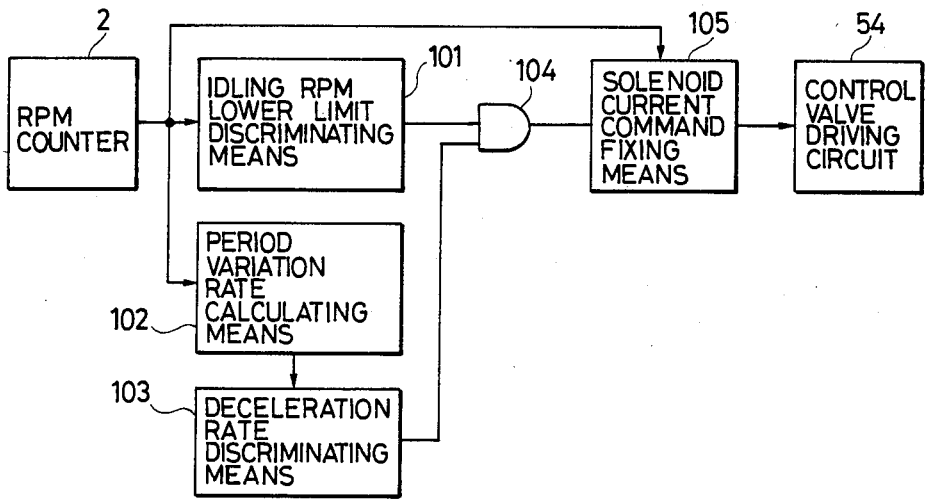
FIG. 1 is a functional block diagram of the present invention.

Now, the construction of this invention will be described below with reference to FIG. 1 which is a functional block diagram of this invention.

Idling RPM lower limit discriminating means 101 gives judgement as to whether or not the number of engine rotations detected by the RPM counter 2 is smaller than the lower limit of the prescribed range of numbers of idling rotations. When the answer is in the affirmative, a logical "1" signal is fed to one of the terminals of an AND gate 104 to open the AND gate 104.

Period variation rate calculating means 102 calculates the rate of period variation ΔMe of the number of engine rotations, for example, based on the current value Me(n) and the previous value Me(n−6) of measurement obtained with respect to a particular cylinder.

Deceleration rate discriminating means 103 forms judgement as to whether or not the value, ΔMe is larger than the prescribed rate of change of the period. When the answer is in the affirmative, a logical "1" signal is fed to the other terminal of the AND gate 104 for shifting the engine, or more directly the control valve 30 (FIG. 2) to the open loop control mode in a low speed range.

The signal "1" is fed as a read-out signal to solenoid current command fixing means 105 through the AND gate 104.

The solenoid current command fixing means 105 stores therein the Ne-Ilop table, from which the prescribed quantity of control, Ilop, is read out with the number of engine rotations Ne as an address signal. Then, the quantity of control, Ilop, is fed out as a solenoid current command, Icmd, to the control value driving circuit 54.

The embodiment of this invention has been described as using the quantity of control, Ilop, mentioned above as a solenoid current command, Icmd, and feeding it as it is to the control valve driving circuit 54. Optionally, this invention may obtain the solenoid current command, Icmd, by adding the feedback control term, Ifb(n), existing immediately before the shift to the low speed range open loop control mode or the learned value, Ixref, to Ilop and feed this new command to the control valve driving circuit 54 instead.

In this case, however, the quantity of control, Ilop, should be a smaller value as indicated by the broken line in FIG. 5, because the Ilop serves as a correction term for Ifb(n) or Ixref.

Otherwise, the solenoid current command, Icmd, may be fixed by adding the prescribed quantity of control, Itw, according with the engine temperature detected by the engine temperature sensor 4 to the quantity of control, Ilop, for example.

This is because the mechanical load exerted on the engine is liable to increase as the engine temperature falls and decrease as the engine temperature rises.

As is clear from the description given above, the present invention brings about the following effect.

When the number of engine rotations falls below the lower limit of the prescribed range of numbers of idling rotations while the engine is in an idle operation, the possible occurrence of engine stall or other similar trouble can be precluded by shifting the existing feedback control mode to the open loop control mode which enables the solenoid current command to surpass the quantity of control existing during the feedback control.

What is claimed is:

1. An apparatus for the control of the number of idling rotations of an internal combustion engine, possessed of a control valve to control an amount of inspired air in said internal combustion engine during an idle operation thereof by proportionately controlling a degree of opening of said control valve in accordance with a control valve command, which apparatus comprises:

a RPM counter for detecting a number of rotations of said internal combustion engine, first discriminating means to receive an output of said RPM counter and, on consequently detecting the fact that a current number or engine rotations is lower by a prescribed quantity than a target number of idling rotations, issue a signal indicative of an outcome of the detection, second discriminating means to examine the number of engine rotations, based on the output of said RPM counter, to determine that said number is inclined to decrease as prescribed, and issue a signal of discrimination indicative of the outcome of the detection, and signal generating means to switch said control valve from a feedback control mode to a low speed range open loop control mode in response to the signals of discrimination issued by said first discriminating means and second discriminating means and generate to feed out a prescribed control valve command(Icmd).

2. An apparatus according to claim 1, wherein said second discriminating means calculates the rate of change of the number of engine rotations and, when this rate of change is found to be larger than the prescribed standard quantity, issues said signal of discrimination.

3. An apparatus according to claim 1, wherein said control valve command (Icmd) issued by said signal generating means increases as the number of engine rotations decreases.

4. An apparatus according to claim 1, wherein said control valve command is the sum of the current command in the feedback control mode immediately before said shift to said low speed range open-loop control mode and the prescribed value.

5. An apparatus according to claim 4, wherein said prescribed value increases as the number of engine rotations decreases.

* * * * *